US010130179B2

(12) United States Patent
Clardy et al.

(10) Patent No.: US 10,130,179 B2
(45) Date of Patent: Nov. 20, 2018

(54) APPARATUS AND METHOD FOR A CHAIR RUNNER

(71) Applicants: Sarah Clardy, Chattanooga, TN (US); Jonathan Clardy, Chattanooga, TN (US)

(72) Inventors: Sarah Clardy, Chattanooga, TN (US); Jonathan Clardy, Chattanooga, TN (US)

( * ) Notice: Subject to any disclaimer, the term of this patent is extended or adjusted under 35 U.S.C. 154(b) by 0 days.

(21) Appl. No.: 15/282,013

(22) Filed: Sep. 30, 2016

(65) Prior Publication Data

US 2017/0095086 A1 Apr. 6, 2017

Related U.S. Application Data

(60) Provisional application No. 62/236,317, filed on Oct. 2, 2015, provisional application No. 62/280,254, filed on Jan. 19, 2016.

(51) Int. Cl.
*A47C 3/029* (2006.01)

(52) U.S. Cl.
CPC ..... *A47C 3/029* (2013.01)

(58) Field of Classification Search
CPC ..... A47C 3/02; A47C 3/029
See application file for complete search history.

(56) References Cited

U.S. PATENT DOCUMENTS 264,917 A * 9/1882 Andrews ..... A47C 3/029 297/133
1,317,580 A * 9/1919 Kanode ..... A47C 3/029 297/272.1
1,566,157 A * 12/1925 Michaelson ..... A47C 3/029 297/133
3,306,660 A * 2/1967 Williams ..... A61G 5/104 280/211
4,079,991 A * 3/1978 Harris ..... A47C 3/029 297/133
5,486,034 A * 1/1996 Dalke ..... A47C 3/029 297/133
6,086,147 A * 7/2000 Gladstone ..... A47C 3/029 297/133
6,328,378 B1 * 12/2001 Erickson ..... A47C 3/029 297/133
8,465,101 B1 * 6/2013 Alvarez ..... A47B 95/002 297/182

* cited by examiner

*Primary Examiner* — Philip F Gabler

(74) *Attorney, Agent, or Firm* — Chambliss, Bahner & Stophel, P.C.

(57) ABSTRACT

A chair runner having a first end and a second end and comprising a first side having a first recessed portion and a second recessed portion, a second side that is substantially arcuate and an attachment means. The first recessed portion is disposed adjacent to the first end and the second recessed portion is disposed adjacent to the second end, the first recessed portion is adapted to removably receive a first leg of a stationary chair and the second recessed portion is adapted to removably receive a second leg of the stationary chair, and the attachment means is adapted to removably secure the chair runner to the stationary chair. A method for converting a stationary chair having at least four legs into a rocking chair comprising removably attaching each of the at least one pair of chair runners to two legs of the stationary chair.

18 Claims, 7 Drawing Sheets

FIGURE 2
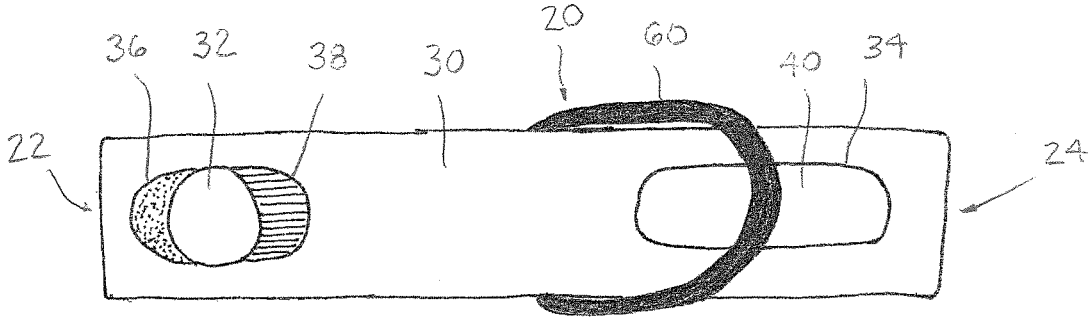
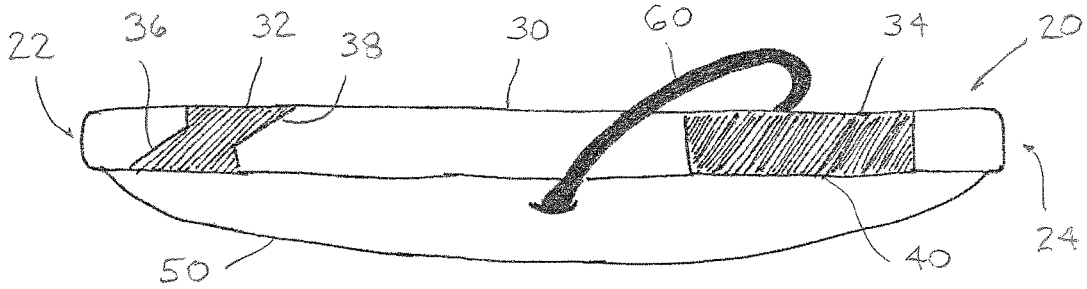
FIGURE 1
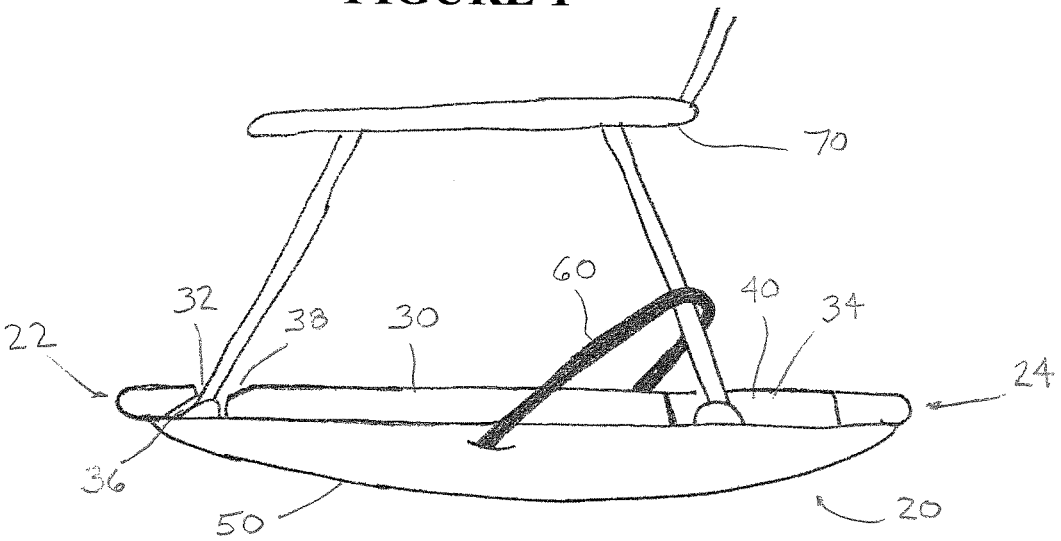
FIGURE 3

FIGURE 10
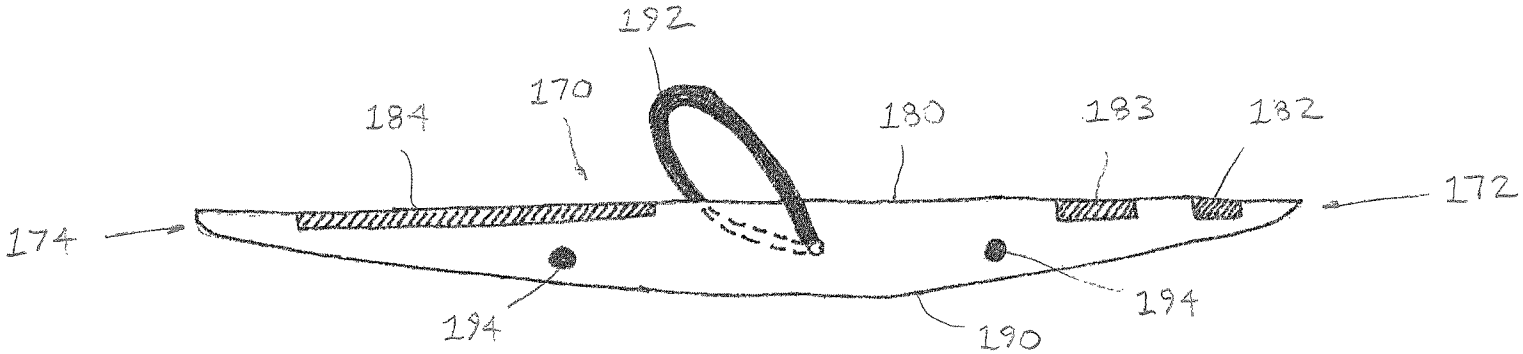
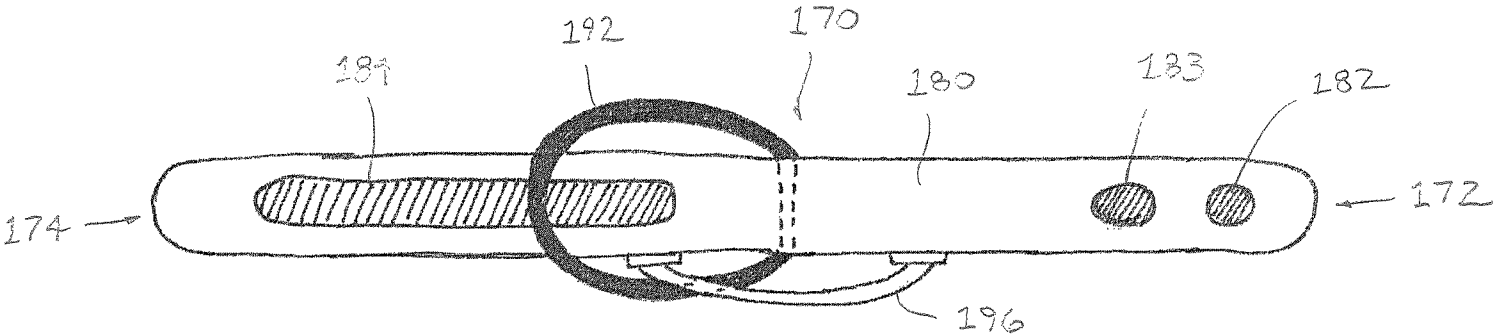
FIGURE 11

FIGURE 14
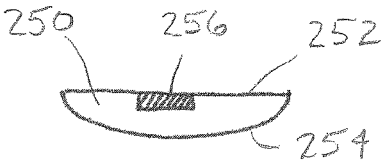
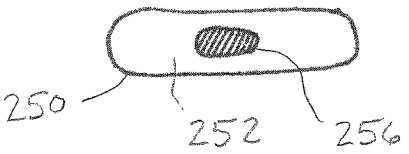
FIGURE 15
FIGURE 13
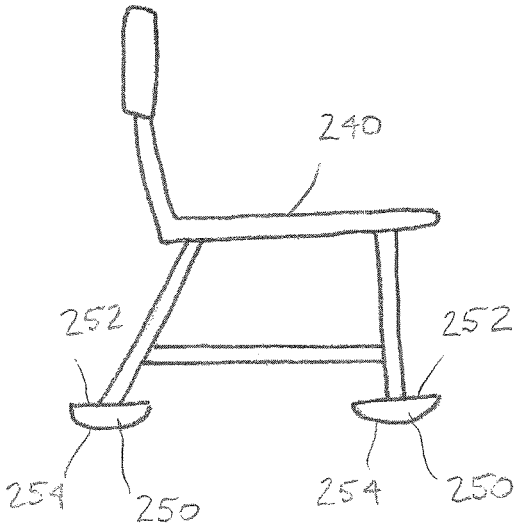

APPARATUS AND METHOD FOR A CHAIR RUNNER

CROSS-REFERENCES TO RELATED APPLICATIONS/PATENTS

This application relates back to and claims the benefit of priority from U.S. Provisional Application for Patent Ser. No. 62/280,254 titled "Chair Runners" and filed on Jan. 19, 2016 and U.S. Provisional Application for Patent Ser. No. 62/236,317 titled "Chair Runners" and filed on Oct. 2, 2015.

FIELD OF THE INVENTION

The present invention relates generally to systems and methods for rocking chairs, and particularly to apparatuses and methods for converting stationary chairs into rocking chairs.

BACKGROUND AND DESCRIPTION OF THE PRIOR ART

It is known to use apparatuses and methods to convert a conventional stationary chair into a rocking chair. Conventional apparatuses and methods, however, suffer from one or more disadvantages. For example, conventional apparatuses and methods are not adapted for use on different-sized chairs. Conventional apparatuses and methods are also undesirably complex, expensive, and difficult to attach to and remove from a chair. Further, conventional apparatuses and methods are undesirably bulky and difficult to transport and store. Still further, conventional apparatuses and methods are undesirably limited to front-to-rear rocking. In addition, conventional apparatuses and methods do not adequately secure the chair runners to the chair. Conventional apparatuses and methods also have an undesirably high degree of slope.

It would be desirable, therefore, if an apparatus and method for a chair runner could be provided that would be adapted for use on different-sized chairs. It would also be desirable if such an apparatus and method for a chair runner could be provided that would be simple, inexpensive, and easy to attach to and remove from a chair. It would be further desirable if such an apparatus and method for a chair runner could be provided that would be compact and easy to transport and store. It would be still further desirable if such an apparatus and method for a chair runner could be provided that would be adapted to permit front-to-rear rocking and side-to-side rocking. In addition, it would be desirable if such an apparatus and method for a chair runner could be provided that would be adapted to be adequately secured to a chair. It would also be desirable if such an apparatus and method for a chair runner could be provided that would have a lower degree of slope.

Advantages of the Preferred Embodiments of the Invention

Accordingly, it is an advantage of the preferred embodiments of the invention claimed herein to provide an apparatus and method for a chair runner that is adapted for use on different-sized chairs. It is also an advantage of the preferred embodiments of the invention claimed herein to provide an apparatus and method for a chair runner that is simple, inexpensive, and easy to attach to and remove from a chair. It is another advantage of the preferred embodiments of the invention claimed herein to provide an apparatus and method for a chair runner that is compact and easy to transport and store. It is still another advantage of the preferred embodiments of the invention claimed herein to provide an apparatus and method for a chair runner that is adapted to permit front-to-rear rocking and side-to-side rocking. It is yet another advantage of the preferred embodiments of the invention claimed herein to provide an apparatus and method for a chair runner that is adapted to be adequately secured to a chair. In addition, it is an advantage of the preferred embodiments of the invention claimed herein to provide an apparatus and method for a chair runner that has a lower degree of slope.

Additional advantages of the preferred embodiments of the invention will become apparent from an examination of the drawings and the ensuing description.

SUMMARY OF THE INVENTION

The apparatus of the invention comprises a chair runner having a first end and a second end. The preferred chair runner comprises a first side having a first recessed portion and a second recessed portion spaced apart from the first recessed portion. The preferred chair runner also comprises a second side that is substantially arcuate and an attachment means. Preferably, the first recessed portion is disposed adjacent to the first end and the second recessed portion is disposed adjacent to the second end, the first recessed portion is adapted to removably receive a first leg of a stationary chair and the second recessed portion is adapted to removably receive a second leg of the stationary chair, and the attachment means is adapted to removably secure the chair runner to the stationary chair.

The method of the invention comprises a method for converting a stationary chair having at least four legs into a rocking chair. The preferred method comprises providing at least one pair of chair runners. Each of the preferred at least one pair of chair runners comprises a first side having a first recessed portion and a second recessed portion spaced apart from the first recessed portion. The preferred chair runner also comprises a second side that is substantially arcuate and an attachment means. Preferably, the first recessed portion is disposed adjacent to the first end and the second recessed portion is disposed adjacent to the second end, the first recessed portion is adapted to removably receive a first leg of a stationary chair and the second recessed portion is adapted to removably receive a second leg of the stationary chair, and the attachment means is adapted to removably secure the chair runner to the stationary chair. The preferred method further comprises removably attaching each of the at least one pair of chair runners to two legs of the stationary chair.

BRIEF DESCRIPTION OF THE DRAWINGS

The presently preferred embodiments of the invention are illustrated in the accompanying drawings, in which like reference numerals represent like parts throughout, and in which:

FIG. 1 is a partial sectional front view of the preferred embodiment of the chair runner in accordance with the present invention.

FIG. 2 is a top view of the preferred chair runner illustrated in FIG. 1.

FIG. 3 is a partial sectional front view of the preferred chair runner illustrated in FIGS. 1-2 shown on an exemplary chair.

FIG. 10 is a partial sectional front view of a fourth alternative embodiment of the chair runner in accordance with the present invention.

FIG. 11 is a top view of the fourth alternative embodiment of the chair runner illustrated in FIG. 10.

FIG. 13 is a front view of a sixth alternative embodiment of the chair runner in accordance with the present invention shown on an exemplary chair.

FIG. 14 is a partial sectional front view of the sixth alternative embodiment of the chair runner illustrated in FIG. 13.

FIG. 15 is a top view of the sixth alternative embodiment of the chair runner illustrated in FIGS. 13-14.

DESCRIPTION OF THE PREFERRED EMBODIMENTS OF THE INVENTION

Figure 4:
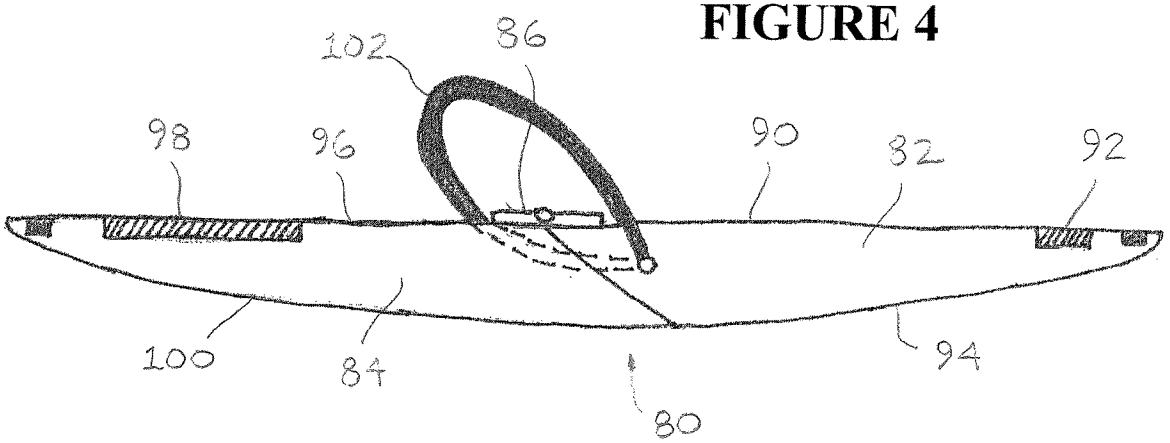
FIG. 4 is a partial sectional front view of a first alternative embodiment of the chair runner in accordance with the present invention.

Referring now to the drawings, the preferred embodiments of the apparatus and method for a chair runner in accordance with the present invention are illustrated by FIGS. 1 through 15. As shown in FIGS. 1-15, the preferred embodiments of the apparatus and method for a chair runner are adapted for use on different-sized chairs. The preferred embodiments of the apparatus and method for a chair runner are simple, inexpensive, and easy to attach to and remove from a chair. The preferred embodiments of the apparatus and method for a chair runner are also compact and easy to transport and store. The preferred embodiments of the apparatus and method for a chair runner are further adapted to permit front-to-rear rocking and side-to-side rocking. In addition, preferred embodiments of the apparatus and method for a chair runner are adapted to be adequately secured to a chair. The preferred embodiments of the apparatus and method for a chair runner also have a lower degree of slope.

Referring now to FIG. 1, a partial sectional front view of the preferred embodiment of the chair runner in accordance with the present invention is illustrated. As shown in FIG. 1, the preferred chair runner is designated generally by reference numeral 20. Preferred chair runner 20 has first end 22 and second end 24 and comprises first side 30 having first recessed portion 32 and second recessed portion 34 which is spaced apart from the first recessed portion. Preferred first side 30 is substantially planar, but it is contemplated within the scope of the invention that the first side may be substantially arcuate. See, e.g., FIG. 12. Preferred first recessed portion 32 is adapted to removably receive a first leg of a stationary chair. More particularly, preferred recessed portion 32 is substantially circular (see also FIG. 2) and disposed adjacent to first end 22 and comprises foot recess 36 and leg recess 38. Preferred second recessed portion 34 is adapted to removably receive a second leg of a stationary chair. More particularly, preferred second recessed portion 34 is disposed adjacent to second end 24 and comprises channel 40 (see also FIG. 2).

Still referring to FIG. 1, preferred chair runner 20 also comprises second side 50 which is substantially arcuate. While preferred second side 50 is substantially arcuate, it is contemplated within the scope of the invention that the second side may comprise a substantially planar portion adapted to minimize rocking and/or substantially prevent rocking in one direction.

Still referring to FIG. 1, preferred chair runner 20 further comprises an attachment means such as elastic cord 60 which is adapted to removably secure the chair runner to a chair. While elastic cord 60 is the preferred attachment means, it is contemplated within the scope of the invention that other suitable attachment means may be used to removably secure preferred chair runner 20 to a chair such as a hook (see FIGS. 8, 9, and 12) or a cleat (see FIGS. 6 and 7).

Referring now to FIG. 2, a top view of preferred chair runner 20 is illustrated. As shown in FIG. 2, preferred chair runner 20 has first end 22 and second end 24 and comprises first side 30, first recessed portion 32, second recessed portion 34, foot recess 36, leg recess 38, channel 40, and elastic cord 60.

Referring now to FIG. 3, a partial sectional front view of preferred chair runner is illustrated on exemplary chair 70. As shown in FIG. 3, preferred chair runner 20 has first end 22 and second end 24 and comprises first side 30, first recessed portion 32, second recessed portion 34, foot recess 36, leg recess 38, channel 40, second side 50, and elastic cord 60.

Referring now to FIG. 4, a partial sectional front view of a first alternative embodiment of the chair runner in accordance with the present invention is illustrated. As shown in FIG. 4, the first alternative embodiment of the chair runner is designated generally by reference numeral 80. Preferred chair runner 80 has first portion 82 and second portion 84 which are pivotally connected to each other such as by hinge 86. While first portion 82 and second portion 84 are preferably pivotally connected by hinge 86, it is contemplated within the scope of the invention that the first portion and the second portion may be connected to each other by any suitable device, mechanism, assembly, or combination thereof.

Still referring to FIG. 4, preferred first portion 82 comprises first portion first side 90 having first recessed portion 92 and first portion second side 94 which is substantially arcuate. Preferred first recessed portion 92 is adapted to removably receive a first leg of a stationary chair. Preferred second portion 84 comprises second portion first side 96 having second recessed portion 98 and second portion second side 100 which is substantially arcuate. Preferred second recessed portion 98 is adapted to removably receive a second leg of a stationary chair.

Still referring to FIG. 4, preferred chair runner 80 further comprises an attachment means such as elastic cord 102. Preferred elastic cord 102 is adapted to removably secure chair runner 80 to a stationary chair.

Figure 5:
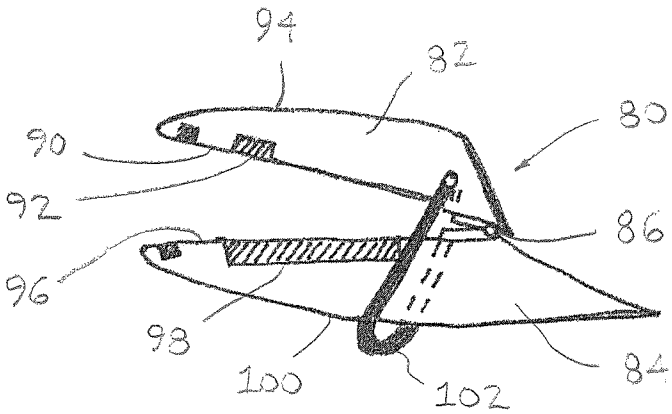
FIG. 5 is a partial sectional front view of the first alternative embodiment of the chair runner illustrated in FIG. 4.

Referring now to FIG. 5, a partial sectional front view of preferred chair runner 80 is illustrated. As shown in FIG. 5, preferred chair runner has first portion 82 and second portion 84 which are pivotally connected to each other by hinge 86. Preferred first portion 82 comprises first portion first side 90 having first recessed portion 92 and first portion second side 94. Preferred second portion 84 comprises second portion first side 96 having second recessed portion 98 and second portion second side 100. Preferred chair runner 80 further comprises elastic cord 102.

Figure 6:
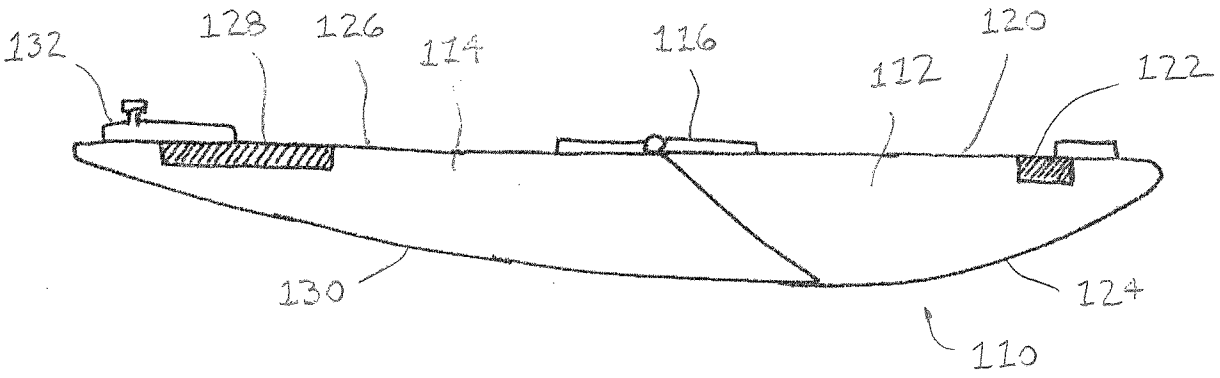
FIG. 6 is a partial sectional front view of a second alternative embodiment of the chair runner in accordance with the present invention.

Referring now to FIG. 6, a partial sectional front view of a second alternative embodiment of the chair runner in accordance with the present invention is illustrated. As shown in FIG. 6, the second alternative embodiment of the chair runner is designated generally by reference numeral 110. Preferred chair runner 110 has first portion 112 and second portion 114 which are pivotally connected to each other such as by hinge 116. While first portion 112 and second portion 84 are preferably pivotally connected by hinge 116, it is contemplated within the scope of the invention that the first portion and the second portion may be connected to each other by any suitable device, mechanism, assembly, or combination thereof.

Still referring to FIG. 6, preferred first portion 112 comprises first portion first side 120 having first recessed portion 122 and first portion second side 124 which is substantially arcuate.

Preferred first recessed portion 122 is adapted to removably receive a first leg of a stationary chair. Preferred second portion 114 comprises second portion first side 126 having second recessed portion 128 and second portion second side 130 which is substantially arcuate. Preferred second recessed portion 128 is adapted to removably receive a second leg of a stationary chair.

Still referring to FIG. 6, preferred chair runner 80 further comprises an attachment means such as cleat 132. Preferred cleat 132 is adjustable and adapted to removably secure chair runner 110 to a stationary chair.

Figure 7:
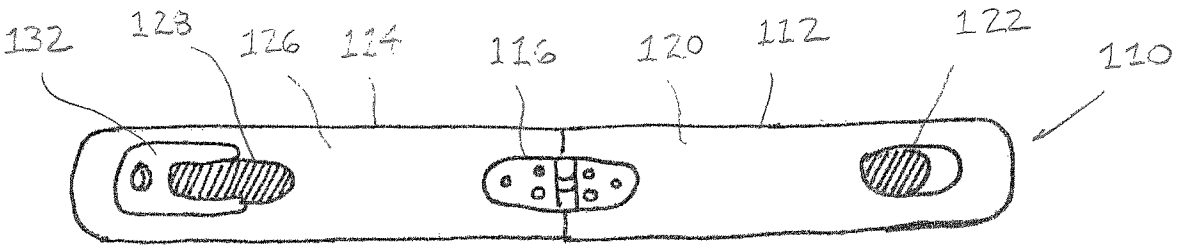
FIG. 7 is a top view of the second alternative embodiment of the chair runner illustrated in FIG. 6.

Referring now to FIG. 7, a top view of preferred chair runner 110 is illustrated. As shown in FIG. 7, preferred chair runner has first portion 112 and second portion 114 which are pivotally connected to each other by hinge 116. Preferred first portion 112 comprises first portion first side 120 having first recessed portion 122. Preferred second portion 114 comprises second portion first side 126 having second recessed portion 128. Preferred chair runner 110 further comprises cleat 132.

Figure 8:
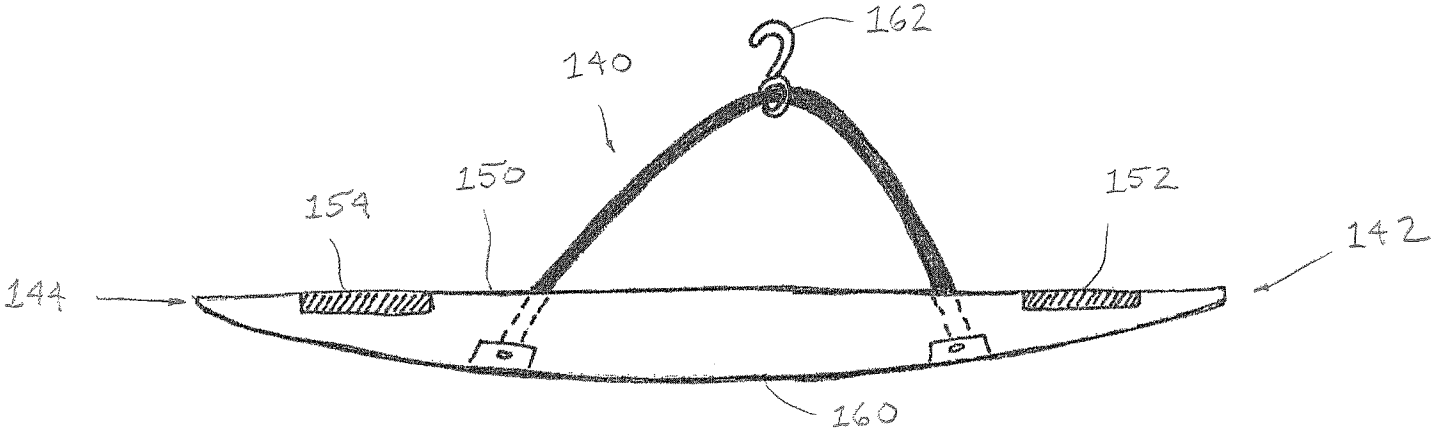
FIG. 8 is a partial sectional front view of a third alternative embodiment of the chair runner in accordance with the present invention.

Referring now to FIG. 8, a partial sectional front view of a third alternative embodiment of the chair runner in accordance with the present invention is illustrated. As shown in FIG. 8, the third alternative embodiment of the chair runner is designated generally by reference numeral 140. Preferred chair runner 140 has first end 142 and second end 144 and comprises first side 150 having first recessed portion 152 and second recessed portion 154 which is spaced apart from the first recessed portion. Preferred chair runner 140 also comprises second side 160 which is substantially arcuate. Preferred chair runner 140 further comprises an attachment means such as hook 162. Preferred hook 162 is adapted to removably secure chair runner 140 to a stationary chair.

Figure 9:
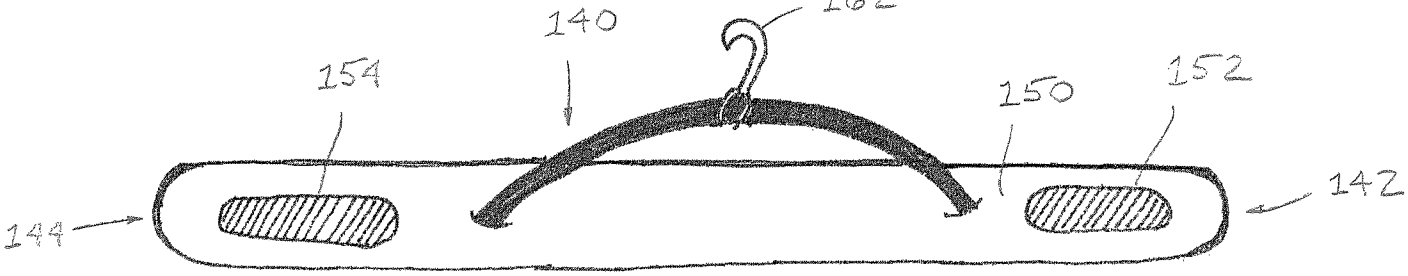
FIG. 9 is a top view of the third alternative embodiment of the chair runner illustrated in FIG. 8.

Referring now to FIG. 9, a top view of preferred chair runner 140 is illustrated. As shown in FIG. 9, preferred chair runner 140 has first end 142 and second end 144 and comprises first side 150, first recessed portion 152, second recessed portion 154, and hook 162.

Referring now to FIG. 10, a partial sectional front view of a fourth alternative embodiment of the chair runner in accordance with the present invention is illustrated. As shown in FIG. 10, the fourth alternative embodiment of the chair runner is designated generally by reference numeral 170. Preferred chair runner 170 has first end 172 and second end 174 and comprises first side 180 having first recessed portion 182, second recessed portion 183, and third recessed portion 184. Preferred chair runner 170 also comprises second side 190 which is substantially arcuate. Preferred chair runner 170 further comprises an attachment means such as elastic cord 192. Preferred chair runner 170 still further comprises magnets 194 which are adapted to make storing and transporting the chair runner easier.

Referring now to FIG. 11, a top view of preferred chair runner 170 is illustrated. As shown in FIG. 11, preferred chair runner 170 has first end 172 and second end 174 and comprises first side 180, first recessed portion 182, second recessed portion 183, third recessed portion 184, and elastic cord 192. Preferred chair runner 170 still further comprises handle 196 which is adapted to make transporting the chair runner easier.

Figure 12:
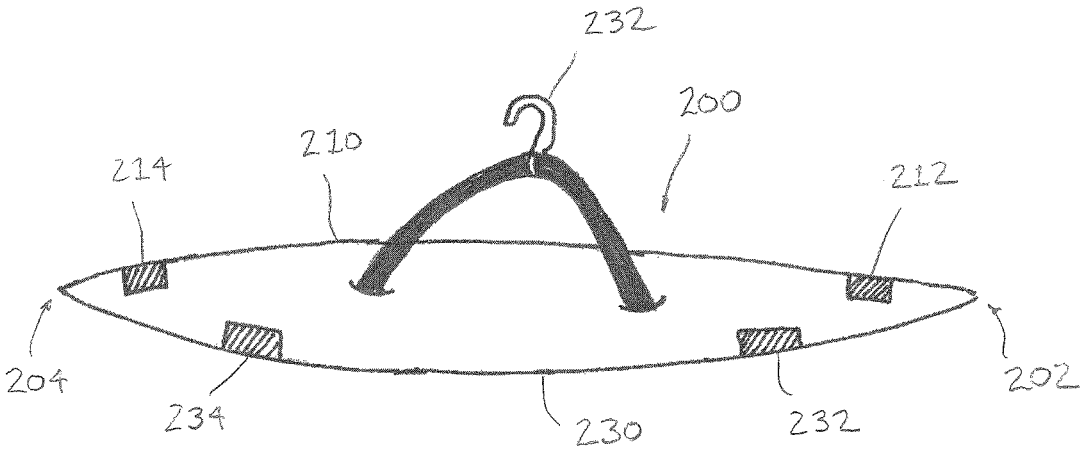
FIG. 12 is a partial sectional front view of a fifth alternative embodiment of the chair runner in accordance with the present invention.

Referring now to FIG. 12, a partial sectional front view of a fifth alternative embodiment of the chair runner in accordance with the present invention is illustrated. As shown in FIG. 12, the fifth alternative embodiment of the chair runner is designated generally by reference numeral 200. Preferred chair runner 200 has first end 202 and second end 204 and comprises first side 210 having first recessed portion 212 and second recessed portion 214 which is spaced apart from the first recessed portion. Preferred first side 201 is substantially arcuate so that it may be the floor-contacting side of chair runner 200. Preferred chair runner 200 also comprises second side 230 which is also substantially arcuate and adapted to be the floor-contacting side of the chair runner. Preferred second side 230 also comprises third recessed portion 232 and fourth recessed portion 234 which is spaced apart from the third recessed portion. More particularly, third recessed portion and fourth recessed portion are disposed closer to each other than first recessed portion and second recessed portion so that chair runner 200 may be used with a wide variety of different-sized chairs. Preferred chair runner 200 further comprises an attachment means such as hook 232.

Referring now to FIG. 13, a front view of a sixth alternative embodiment of the chair runner in accordance with the present invention shown on exemplary chair 240 is illustrated. As shown in FIG. 13, the preferred sixth alternative embodiment of the chair runner is designated generally by reference numeral 250. Each of preferred chair runners 250 is adapted to removably receive one leg of exemplary chair 240 and comprises first side 252 and second side 254. While FIG. 13 illustrates two preferred chair runners 250, it is contemplated within the scope of the invention that one chair runner may be provided for each leg of a chair, regardless of the number of legs on the chair.

Referring now to FIG. 14, a partial sectional front view of preferred chair runner 250 is illustrated. As shown in FIG. 14, preferred chair runner 250 comprises first side 252, second side 254, and recessed portion 256.

Referring now to FIG. 15, a top view of preferred chair runner 250 is illustrated. As shown in FIG. 15, preferred chair runner 250 comprises first side 252 and recessed portion 256.

The invention also comprises a method for converting a stationary chair having at least four legs into a rocking chair. The preferred method comprises providing at least one pair of chair runners. Each of the preferred at least one pair of chair runners comprises a first side having a first recessed portion and a second recessed portion that is spaced apart from the first recessed portion. Each of the preferred at least one pair of chair runners also comprises a second side that is arcuate and an attachment means. Preferably, the first recessed portion is disposed adjacent to the first end and the second recessed portion is disposed adjacent to the second end, the first recessed portion is adapted to removably receive a first leg of a stationary chair and the second recessed portion is adapted to removably receive a second leg of the stationary chair, and the attachment means is adapted to removably secure the chair runner to the stationary chair. The preferred method also comprises removably attaching each of the at least one pair of chair runners to two legs of the stationary chair.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A chair runner having a first end and a second end, said chair runner comprising:

(a) a first side, said first side having a first recessed portion and a second recessed portion spaced apart from the first recessed portion;

(b) a second side, said second side being substantially arcuate;

(c) an attachment means including an elastic cord forming a loop that is secured to the chair runner;

wherein the first recessed portion is disposed adjacent to the first end and the second recessed portion is disposed adjacent to the second end; and wherein the first recessed portion is adapted to removably receive a first leg of a stationary chair and the second recessed portion is adapted to removably receive a second leg of the stationary chair; and wherein the attachment means is adapted to removably secure the chair runner to the stationary chair via an exposed portion of the loop.

2. The chair runner of claim 1 wherein the first side is substantially planar.

3. The chair runner of claim 1 wherein the first side is substantially arcuate.

4. The chair runner of claim 1 wherein the first recessed portion is substantially circular.

5. The chair runner of claim 1 wherein the first recessed portion comprises a foot recess.

6. The chair runner of claim 1 wherein the first recessed portion comprises a leg recess.

7. The chair runner of claim 1 wherein the second recessed portion comprises a channel.

8. The chair runner of claim 1 wherein the second side comprises a substantially planar portion.

9. The chair runner of claim 1 wherein the attachment means comprises a cleat.

10. The chair runner of claim 1 wherein the attachment means comprises a hook.

11. The chair runner of claim 1 further comprising a hinge.

12. The chair runner of claim 1 further comprising a handle.

13. The chair runner of claim 1 further comprising a magnet.

14. A chair runner having a first portion and a second portion, said chair runner comprising:

(a) a first portion first side, said first portion first side having a first recessed portion;

(b) a first portion second side, said first portion second side being substantially arcuate;

(c) a second portion first side, said second portion first side having a second recessed portion;

(d) a second portion second side, said second portion second side being substantially arcuate;

(e) an attachment means including an elastic cord forming a loop passing through the chair runner;

wherein the first portion is pivotally connected to the second portion; and wherein the first recessed portion is adapted to removably receive a first leg of a stationary chair and the second recessed portion is adapted to removably receive a second leg of the stationary chair; and wherein the attachment means is adapted to removably secure the chair runner to the stationary chair via an exposed portion of the loop.

15. The chair runner of claim 14 wherein the first recessed portion is substantially circular and comprises a foot recess and a leg recess.

16. The chair runner of claim 14 wherein the second recessed portion comprises a channel.

17. The chair runner of claim 14 wherein the attachment means is a cleat.

18. A method for converting a stationary chair having at least four legs into a rocking chair, said method comprising:

(a) providing at least one pair of chair runners, each of said at least one pair of chair runners comprising:

(i) a first side, said first side having a first recessed portion and a second recessed portion spaced apart from the first recessed portion;

(ii) a second side, said second side being substantially arcuate;

(iii) an attachment means including an elastic cord forming a loop that is secured to the chair runner;

wherein the first recessed portion is disposed adjacent to the first end and the second recessed portion is disposed adjacent to the second end; and wherein the first recessed portion is adapted to removably receive a first leg of a stationary chair and the second recessed portion is adapted to removably receive a second leg of the stationary chair; and wherein the attachment means is adapted to removably secure the chair runner to the stationary chair via an exposed portion of the loop;

(b) removably attaching each of the at least one pair of chair runners to two legs of the stationary chair.

* * * * *